US011643263B2

(12) United States Patent
Monti

(10) Patent No.: US 11,643,263 B2
(45) Date of Patent: May 9, 2023

(54) UNIT OF PACKAGED PRODUCT, AND METHOD OF PACKAGING A PRODUCT

(71) Applicant: Moreno Monti, Monteveglio (IT)

(72) Inventor: Moreno Monti, Monteveglio (IT)

(73) Assignee: UNIFILL S.R.L., Sorbara di Bomporto (IT)

( * ) Notice: Subject to any disclaimer, the term of this patent is extended or adjusted under 35 U.S.C. 154(b) by 105 days.

(21) Appl. No.: 17/137,826

(22) Filed: Dec. 30, 2020

(65) Prior Publication Data

US 2021/0214143 A1 Jul. 15, 2021

(30) Foreign Application Priority Data

Jan. 9, 2020 (IT) ..... 102020000000226

(51) Int. Cl.

| | |
|---|---|
| ***B65D 75/32*** | (2006.01) |
| ***B65D 75/58*** | (2006.01) |
| ***B65D 77/28*** | (2006.01) |
| ***B65B 61/20*** | (2006.01) |

(52) U.S. Cl.

CPC ..... *B65D 77/283* (2013.01); *B65B 61/205* (2013.01); *B65D 75/322* (2013.01); *B65D 75/5811* (2013.01); *B65D 2575/3227* (2013.01); *B65D 2577/10* (2013.01)

(58) Field of Classification Search

CPC ..... B65D 77/283; B65D 77/34; B65D 77/38; B65D 75/322; B65D 75/5811

USPC ..... 220/705

See application file for complete search history.

(56) References Cited

U.S. PATENT DOCUMENTS

| | | | | |
|---|---|---|---|---|
| 5,957,584 | A * | 9/1999 | Lakey | B65D 75/5811 383/906 |
| 7,594,578 | B2 * | 9/2009 | Smith | A61J 1/067 604/416 |
| 2009/0304873 | A1 | 12/2009 | Magnoni | |
| 2019/0099025 | A1 * | 4/2019 | Rieger | A47G 21/182 |

FOREIGN PATENT DOCUMENTS

| | | | |
|---|---|---|---|
| EP | 1072531 | A2 | 1/2001 |
| EP | 1685812 | A2 | 8/2006 |
| WO | 96/32342 | A1 | 10/1996 |
| WO | 2006/126046 | A1 | 11/2006 |

OTHER PUBLICATIONS

Italian Search Report from the Italian Patent Office issued in corresponding Italian Application No. 102020000000226, dated Oct. 7, 2020 (9 pages).

* cited by examiner

*Primary Examiner* — Anthony D Stashick
*Assistant Examiner* — Raven Collins
(74) *Attorney, Agent, or Firm* — Flynn Thiel, P.C.

(57) ABSTRACT

A packaged product unit including a package with an inner cavity having a pocket portion containing a product and communicating with an elongated portion in which a straw is housed. The straw has a proximal end which leads into the pocket portion and a distal end which is closed by a cap portion of the package. An outer wall of the straw is welded perimetrically to the package in a proximal sealing area at the proximal end of the straw to prevent leakage of the product from the pocket portion along an outer surface of the straw.

20 Claims, 3 Drawing Sheets

UNIT OF PACKAGED PRODUCT, AND METHOD OF PACKAGING A PRODUCT

CROSS-REFERENCE TO RELATED APPLICATIONS

This claims priority from Italian Application No. 102020000000226, filed Jan. 9, 2020, the disclosure of which is hereby incorporated by reference in its entirety.

FIELD OF INVENTION

This invention concerns a packaged product unit. The invention has been developed with particular regard to a packaged product unit which includes a straw that remains sealed in the package until the product is used. The invention also concerns a method of packaging a product.

TECHNOLOGICAL BACKGROUND

Units of packaged product are known, which include a straw that remains sealed in the package until the product is used. The straw remains protected inside the package until the package is opened and the straw is partially exposed so that, for example, the product can be sipped therethrough. The products can be of various types, although in this sector most products are edible. Examples of products typically packaged in units of the above type are edible liquids or pastes, such as fruit juices, syrups, milk-based drinks, and the like.

An example of packaging units of the above type is described in document WO 96/32342 by this Applicant.

The production of such a straw packaging unit is satisfactory, but rather complex. The use of the edible product is not very easy, because the user has to push the straw into the container to activate the communication of the straw with the liquid in the package. In addition, there is a risk of product spillage due to the pressure exerted on the straw.

SUMMARY OF THE INVENTION

The aim of the invention is to solve the problems of the known technique, and to provide a product unit of the above mentioned type, which is easy and economical to produce, reliable to fill and store and comfortable in use. In particular, the aim of the invention is to provide a packaged product unit in which it is not necessary to manoeuvre the straw in order to use the packaged product, which can therefore be easily accessed. Another aim is to avoid in a simple way that the product inside the container leaks externally along the straw.

Another purpose of the invention is to create a method for packaging a product in a product unit of the type indicated above, which is simple, economical and effective.

These and other purposes are achieved by the invention as discussed below.

According to a first aspect, a packaged product unit that includes a package with an inner cavity is described. The inner cavity can be formed by a pocket portion containing a product. The inner cavity can comprise an elongated portion. The pocket portion can communicate with the elongated portion. The elongated portion can contain a straw. The straw can have a proximal end that can lead into the pocket portion. The inner cavity of the straw can be in communication with the pocket portion. The product can fill the inner cavity of the straw. The distal end of the straw can be closed by a cap portion of the package, so that the product does not get out of the pack. The cap portion can be removed from the rest of the package to enjoy the product, for example, to sip it through the straw. The outer wall of the straw can be welded perimetrically to the package in a proximal sealing area. The proximal sealing area can be substantially at the proximal end of the straw. This can prevent the product from leaking from the pocket portion along the outer surface of the straw. The welding between the packaging and the straw makes them fully integral to each other, continuously sealedly along an annular portion of the straw.

According to one particular aspect, the outer wall of the straw can have a corrugation at its proximal end. The corrugation can facilitate the hold of the welding in the proximal sealing area between the outer wall of the straw and the packaging.

In another particular aspect, the package can comprise a weakening that defines at least one line of separation of the cap portion from the remainder of the package. In use, it is possible, for example, to twist the cap portion to open the package by exposing the distal end of the straw and thus enjoy the product, e.g. to sip it through the straw. The weakening can be interposed between the proximal sealing area and the distal end of the straw, so that when the package is opened the proximal sealing area remains intact and retains its sealing function, preventing leakage of the product from the pocket portion along outside of the straw. The weakening can be adjacent to the proximal sealing area so that as much of the straw as possible is exposed when the package is opened without compromising the sealing in the proximal sealing area.

In another respect, the distal end of the straw can include a breakable portion. The breakable portion can be welded perimetrically to the cap portion of the package in a distal sealing area to seal the distal end of the straw. Sealing the distal end of the straw can prevent the product from leaking out of the inner cavity of the straw. In use, the cap portion of the package can be removed along with the breakable portion of the straw that is welded to the cap portion, leaving the remaining portion of the straw exposed for use.

The distal end of the straw can be externally corrugated to facilitate the hold of the welding at the cap portion of the package. The straw can in any case be symmetrical with respect to its median transverse plane, to favour the manufacturing process of the product unit, without the need to mark or select an orientation to introduce the straw into the package cavity.

According to another aspect, the package can be formed by two opposing shells. The opposing shells can be welded to each other along a continuous seal. The continuous seal can advantageously incorporate the proximal sealing area between the proximal end of the straw and the package. In case the distal sealing area between the distal end of the straw and the cap portion of the package is provided, the continuous seal between the two opposing shells can advantageously incorporate the distal sealing area of the straw.

The package and the straw can both be made of a plastic material, e.g. a thermoplastic material, which facilitates easy and complete welding between the package and the straw where it is required.

In another aspect, a method of packaging a product is described. The method can involve the preparation of a package according to one or more of the above mentioned aspects. The package can then include an inner cavity formed by a pocket portion that communicates with an elongated portion. The package can include an access opening for access to the internal cavity. The packaging method can involve inserting a straw into the elongated portion of the inner cavity, so that a proximal end of the straw leads into the pocket portion and a distal end of the straw is closed by a cap portion of the package. The method can also involve welding perimetrically the outer wall of the straw to the package in a proximal sealing area at the proximal end of the straw to prevent subsequent leakage of product from the pocket portion along the outer surface of the straw. The method can also involve filling the pocket portion with a product through the access opening to the inner cavity. The method can also include welding the access opening to close the internal cavity in which the product is packaged.

According to one particular aspect, the distal end of the straw can include a breakable portion. This breakable portion can be welded perimetrically to the cap portion of the package in a distal sealing area before the pocket portion is filled with the product.

In another particular aspect, the package can be formed by welding two opposing shells against each other along a continuous sealing. The welding of the package to the straw in the proximal sealing area can be incorporated into the continuous seal of the package, thus forming a whole therewith.

BRIEF DESCRIPTION OF THE DRAWINGS

Further characteristics and advantages will be evident from the following detailed description of a preferred embodiment, with reference to the attached drawings, given by way of non-limiting examples.

DETAILED DESCRIPTION

Figure 1:
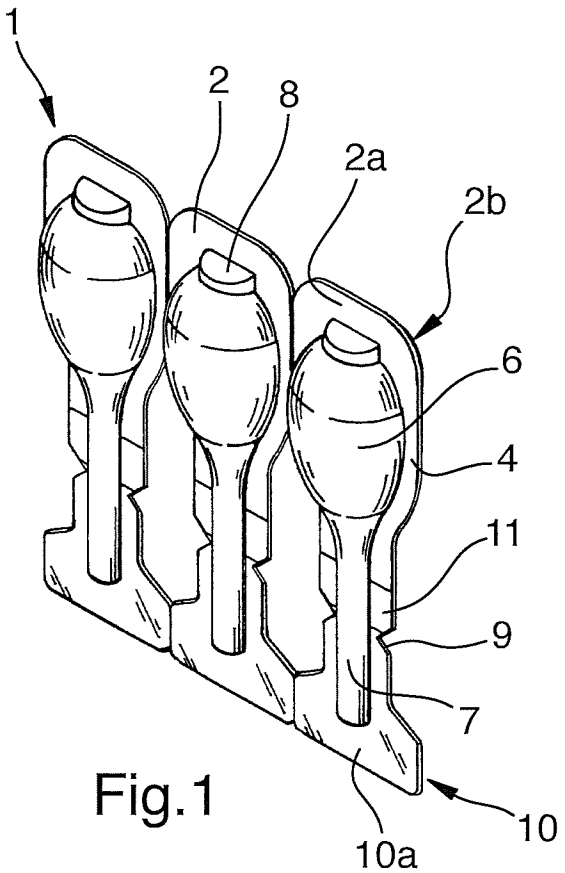
FIG. 1 is a perspective view of a group of packaged product units, incorporating one or more aspects of the present invention.
Figure 2:
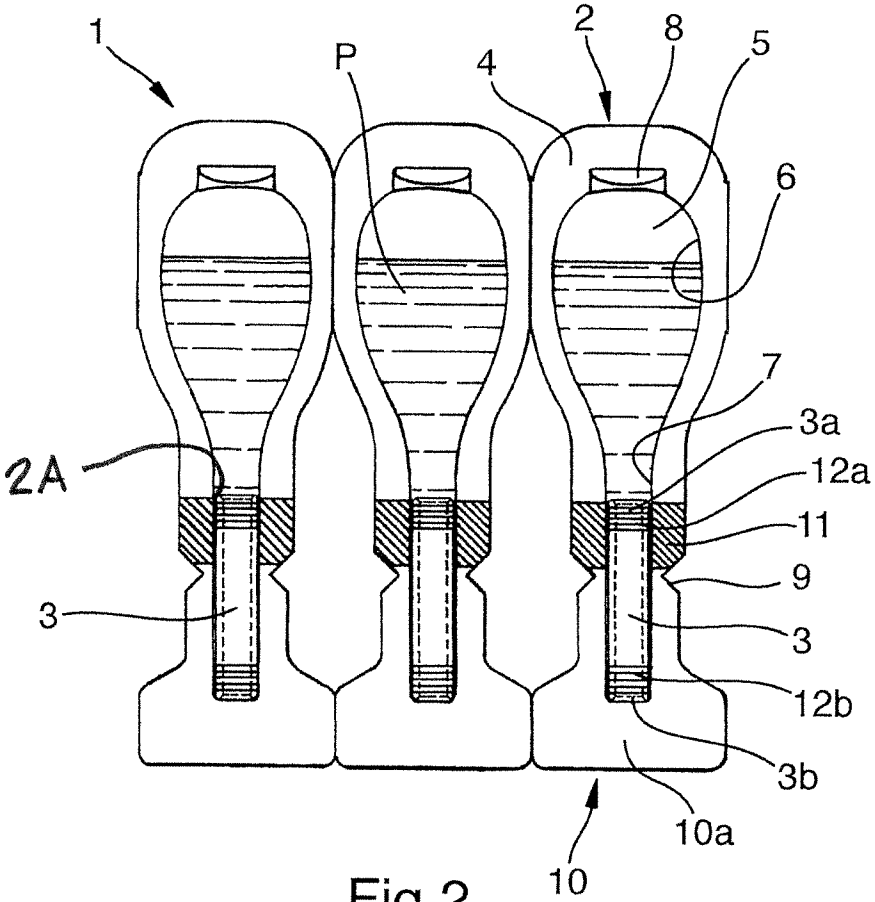
FIG. 2 is a longitudinal section of the packaged product unit group in FIG. 1.

With reference now to FIGS. 1 and 2, a group 1 of units of a packaged product P is shown. Each unit comprises a package 2 inside which a straw 3 is closed and remains sealed in the package 2 until someone wishes to enjoy the product, for example by sipping it through the straw 3 in case of an edible product. Other possible non-food uses can involve a pharmaceutical or parapharmaceutical product, for example eye drops or a disinfectant, or an industrial product, for example a lubricating oil, which can be dispensed through the straw 3. It is convenient to produce the various units of product packaged in groups 1 in which the various units are made, for example, from a long plastic film, and are joined to each other along one or more portions of their edges. The units of product packaged in this way can then be supplied to the market either individually, after separating them from each other, or in groups, keeping them together in a determined number.

The packages 2 are made with two opposing shells 2*a*, 2*b*, e.g. symmetrically opposed shells of any shape, preferably made of plastic, e.g. from a folded film or two opposing films, welded together according to techniques generally known in the field, as described for example in document WO 96/32342 of this Applicant. Opposite shells 2*a*, 2*b* can be joined together by continuous sealing 4, preferably hot sealing, along part of their outer edge, e.g. in the longitudinal median plane of the package 2

The package 2 of each unit of packaged products defines a respective inner cavity 5, large enough to contain the product and preferably, but not limited to, larger than the quantity of product so as to take into account the increase in volume of the product if it is to be subsequently frozen. The inner cavity 5 is formed within a pocket portion 6 and has an opening 2A through which product exits. The pocket portion 6 extends downwards into an elongated portion 7 package 2 which serves as a seat for the straw 3, the proximal end 3*a* of which is in communication with the inner cavity 5 of the pocket portion 6 via the opening 2A.

The straw 3 is completely inserted into the elongated portion 7 so that the distal end 3*b* of straw 3 is plugged by the continuous sealing 4 of package 2. The straw 3 is preferably press-fitted into the elongated portion 7 through an opening 8 which is sealed, as shown in the drawings, after the product P has been introduced into cavity 5. The elongated portion 7 can also be made slightly narrower or tapered with respect to the outer diameter of the straw, creating a slightly interfering fit so that the straw is planted in the elongated portion 7 so that product P does not escape from the distal end 3*b* before the container 2 is opened.

Figure 5:
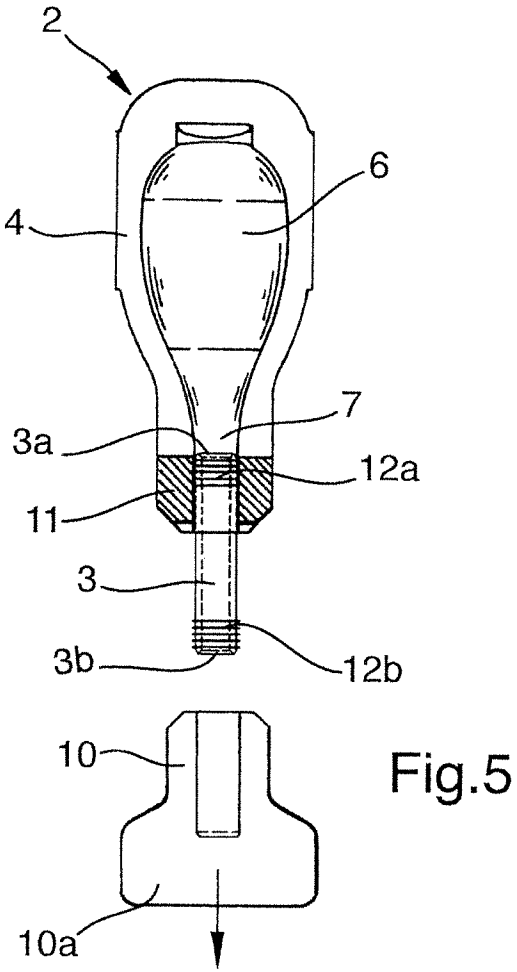
FIG. 5 is a longitudinal section of one of the packaged product units of FIGS. 1 and 2, in the configuration where the straw is partially exposed for use.

To open the container 2, a weakening 9 is provided along the continuous sealing 4, which can be made with a V notch that reduces the width of the continuous sealing, as shown in the figures. Another solution to make the weakening 9 is to make a fracture line or pre-cut on the material of the container 2. The weakening 9 defines a portion of cap 10 in the package 2, which in the example of the figures includes an end tab 10*a*. As can be seen in FIG. 5, the weakening 9 allows one to break the package 2 at the weakening 9, e.g. by twisting the cap portion 10 by grasping it on the end tab 10*a*, so that the distal portion 3*b* and a large part of the straw 3 through which the product P contained in the package 2 can be enjoyed is exposed.

The straw 3 can be made of a plastic material, and in particular of the same plastic material as the shells 2*a*, 2*b*, or in any case of a material that can be easily welded to them, preferably heat-welded. In this respect, the package 2 is welded to the straw 3 at its proximal end 3*a*. More precisely, the shells 2*a*, 2*b* of the package 2 are welded to the outer wall of the straw 3 along its entire periphery, thus forming a proximal sealing area 11 where the material of the straw 3 blends with that of shells 2*a*, 2*b* to form a sealing ring that extends from the proximal end 3*a* of straw 3 along a certain length, e.g. about a third of its length. In this way, leakage of product P from the pocket portion 6 along the outer surface of the straw 3 is prevented. In the case of an edible product P to be sipped through the straw 3, it is advantageous to design the container 2 in such a way that the weakening 9 is just below the proximal sealing area 11, so that the portion of straw 3 which remains exposed after the breakage of the cap portion 10 is long enough to allow the product P to be comfortably sipped without getting the lips too close to the remaining portion of container 2 after the breakage of the weakening 9 and the removal of the cap portion 10.

Figure 4:
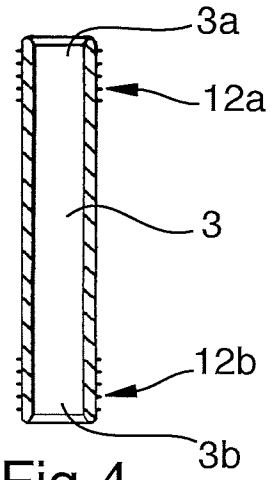
FIG. 4 is a longitudinal section of the straw of FIG. 3.
Figure 3:
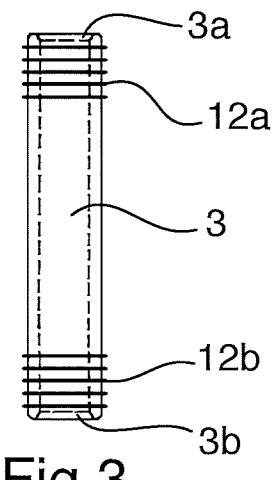
FIG. 3 is a front view of a straw used in each of the packaged product units shown in FIGS. 1 and 2.

To facilitate welding of straw 3 to container 2, the upper end 3*a* of the straw has a corrugation 12*a*, as can also be seen in FIGS. 3 and 4. The corrugation 12*a* can be shaped as a series of ridges and/or annular grooves, or as a knurling, or other design that creates a certain roughness on the outer wall of the straw 3 at the top end 3*a*.

Preferably, the distal end 3*b* of the straw 3 also has a similar corrugation 12*b*, thus being symmetrical with respect to its median transverse plane. In this way, it is not necessary to specifically mark or orient the straws 3 in the production of pack 2, which can thus be introduced into the elongated portion 7 indifferently oriented in either direction, without the need to select their introduction orientation in advance. In other words, the ends of the straw 3 are equal and undifferentiated before the introduction of the straw 3 into the elongated portion 7 of the inner cavity 5, while they assume the roles of proximal portion 3*a* and distal portion 3*b* respectively, after the straw 3 has been inserted firmly and permanently into the elongated portion 7. The presence of the corrugation 12*b* on the distal end 3*b* of the straw 3 also favours the holding of the sealing in correspondence of the cap portion 10 of the package.

In the manufacture of the packaged product units described above, the packages 2 are made from, for example, two opposing plastic films or a plastic film folded to form two opposing flaps. The opposing films or flaps form the half-shells 2*a*, 2*b* of the package 2, and are heat-welded along predefined contour lines to form most of the continuous sealing 4, except in the upper area which remains open to form opening 8. By a known method, e.g. pressure forming, the inner cavity 5 is made which includes the pocket portion 6 and the elongated portion 7. From the upper opening 8, the straw 3 is introduced, which is inserted deeply into the elongated portion 7. After the straw 3 is in place, the package 2 is heat-welded onto the straw 3 in the sealing area 11 located at the proximal end 3*a* of the straw, preferably just above the weakening 9, for the reasons mentioned above. The welding in the sealing area 11 is preferably carried out with the aid of a hot pressing mould or vice. Subsequently, the product P is introduced into the cavity 5 through the upper opening 8, which is then heat-welded to restore the integrity of the continuous sealing 4 along the entire contour of package 2.

Figure 9:
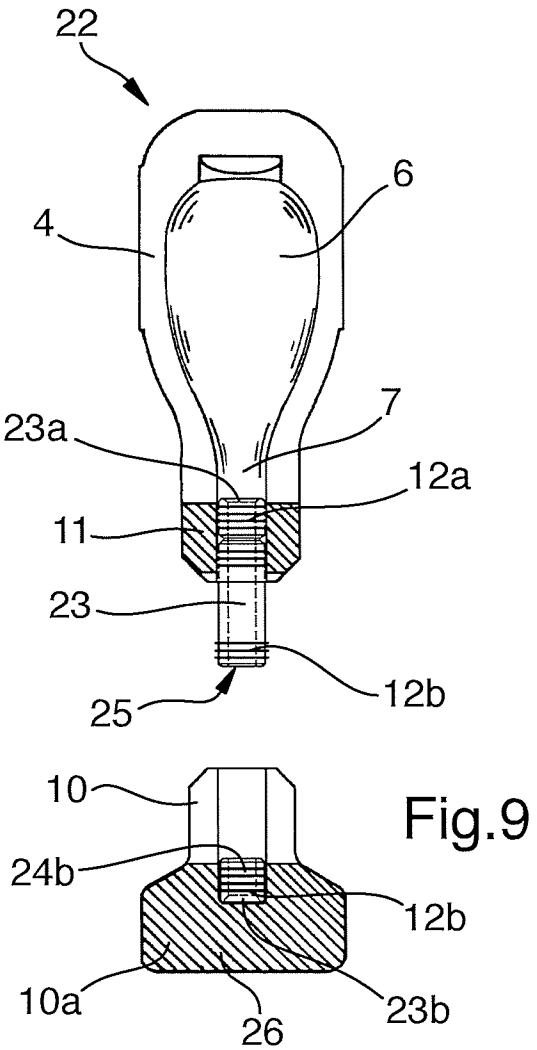
FIG. 9 is a longitudinal section of one of the packaged product units in FIG. 6, in the configuration where one end section of the straw is removed together with a cap portion of the pack, leaving the remaining part of the straw partially exposed for use.
Figure 6:
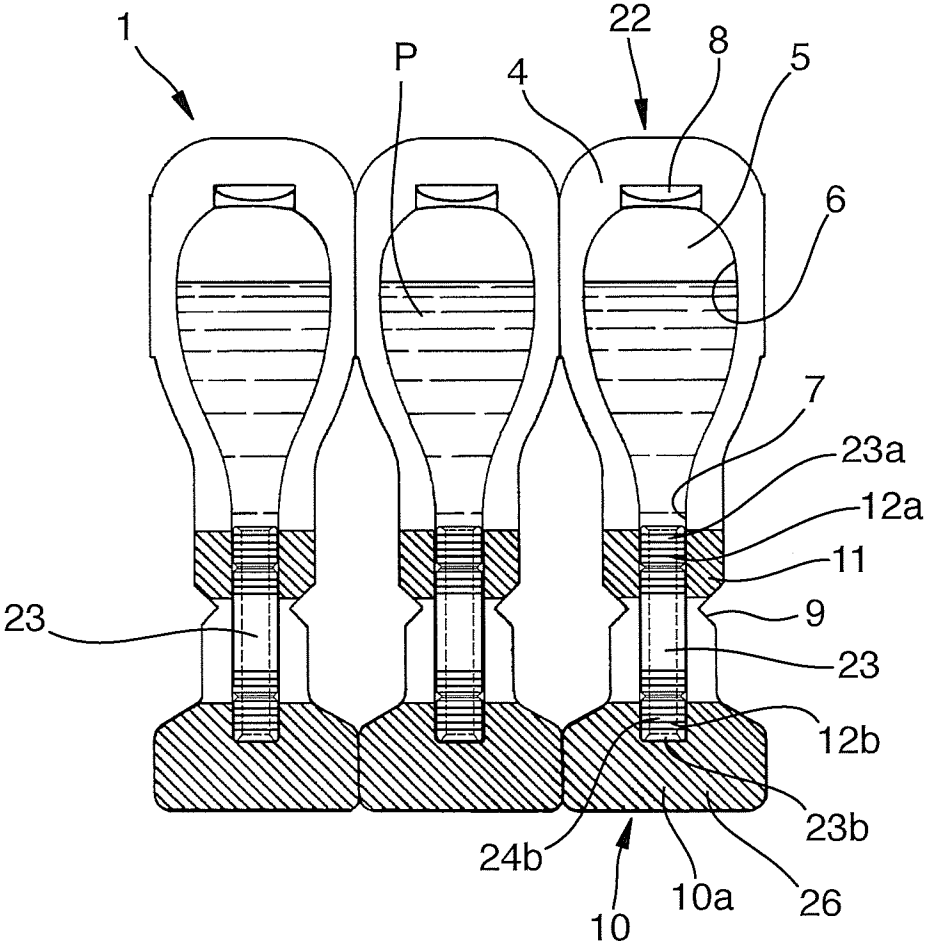
FIG. 6 is a longitudinal section, similar to FIG. 2, of a variant of the packaged product unit group of FIG. 1.

FIGS. 6 and 9 show a variant of product unit P, comprising a package 22 inside which a straw 23 is closed and which, as in the case described above, remains sealed in the package 22 until the product is used. This variant is subject to the same considerations as previously described, except for the differences that will be expressly indicated or will be evident to a technician in the field reading the present description. Identical reference numbers identify features which are identical to those described above.

Figure 8:
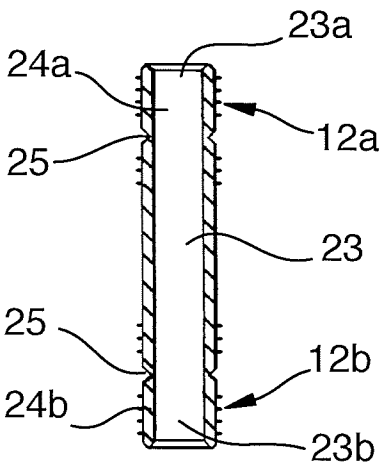
FIG. 8 is a longitudinal section of the straw of FIG. 7.
Figure 7:
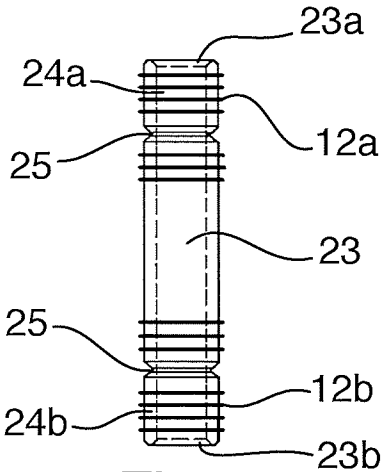
FIG. 7 is a front view of a straw used in each of the packaged product units of FIG. 6.

Again, the packages 22 are preferably made with two opposing shells, joined together by a continuous sealing 4. A straw 23 is inserted completely into the elongated portion 7 so that the distal end 23*b* of the straw 23 is plugged by the continuous sealing 4 of pack 22. As can also be seen in FIGS. 7 and 8, the distal end 23*b* of the straw 23 includes a breakable section 24*b* defined for example by a weakening annular groove 25 on the wall of the straw 23. The corrugation 12*b* preferably extends from the distal end 23*b* along the entire breakable section 24*b* and beyond the weakening annular groove 25 to continue on a section of the outer wall of the straw 23 beyond the breakable section 24*b*. For reasons of symmetry, as described above, there is also a breakable section 24*a* at the proximal end 23*a* of the straw 23 defined by a similar weakening annular groove 25 and affected by corrugation 12*a* which also extends over a section of the outer wall of the straw 23 beyond the breakable section 24*a*.

In the container 22, the welding of the distal end 23*b* of the straw 23 to the cap portion 10, particularly in the area of the tab 10*a*, is carried out in the same way and preferably at the same time of the sealing area 11 near or at the proximal end 23*a* of the straw 23. In this way a distal sealing area 26 is formed which only affects the breakable section 24*b* of the straw 23. The welding of the material of straw 23 to that of the container 22 in the distal sealing area 26 ensures the sealed plugging of the distal end 23*b* of the straw 23, so that the product P in the inner duct of the straw 23 does not leak outside the distal end 23*b* of the straw 23.

When using the container 22, a twist on the cap portion 10, and in particular on the tab 10*a*, causes both the fracture of the weakening 9 previously described and the fracture of the distal breakable section 24*b* of the straw 23, which remains attached to the cap portion 10 as shown in FIG. 9, exposing the end of the straw 23 starting from the weakening annular groove 25 where the straw 23 broke when the container 22 was opened.

Naturally, without prejudice to the principle of the invention, the embodiments and the details of realisation can vary widely with respect to what has been described and illustrated, without departing from the scope of the present invention.

The invention claimed is:

1. A unit of packaged product, comprising a package with an inner cavity formed by a pocket portion, the inner cavity containing a product, the package having an elongated portion, a straw housed in the elongated portion and a cap portion, the straw having a proximal end portion in fluid communication with the inner cavity of the pocket portion and a distal end portion spaced from the proximal end portion and closed by the cap portion, the proximal end portion of the straw having a terminal proximal edge, the straw having an outer wall welded perimetrically to the package in a proximal sealing area at the proximal end portion of the straw to form a sealing ring, the sealing ring extending from the terminal proximal edge of the straw and towards the distal end portion of the straw to prevent leakage of the product from the inner cavity of the pocket portion along an outer surface of the outer wall of the straw.

2. The unit of packaged product according to claim 1, wherein the outer wall of the straw at the proximal end portion thereof comprises external corrugations to facilitate holding of the welding in the proximal sealing area between the outer wall of the straw and the package.

3. The unit of packaged product according to claim 1, wherein the package includes a weakening defining at least one line of separation between the cap portion and a remainder of the package, the weakening being interposed between the proximal sealing area and the distal end portion of the straw.

4. The unit of packaged product according to claim 3, wherein the weakening is adjacent to the proximal sealing area.

5. The unit of packaged product according to claim 1, wherein the outer wall of the straw at the distal end portion thereof includes a breakable section welded perimetrically to the cap portion of the package in a distal sealing area to sealingly close the distal end portion of the straw.

6. The unit of packaged product according to claim 1, wherein the distal end portion of the straw comprises external corrugations to facilitate sealing at the cap portion of the package.

7. The unit of packaged product according to claim 5, wherein the package includes two opposing shells welded to each other along a continuous sealing area, the continuous sealing area incorporating the proximal sealing area.

8. The unit of packaged product according to claim 7, wherein the continuous sealing area also incorporates the distal sealing area.

9. The unit of packaged product according to claim 1, wherein the package and the straw are both made of a plastic material.

10. The unit of packaged product according to claim 1, wherein the straw is symmetrical with respect to a median transverse plane thereof.

11. A method of packaging a product in a unit, comprising the steps of:

providing a package with an inner cavity formed by a pocket portion, the inner cavity communicating with an elongated portion, and an access opening providing access to the inner cavity;

providing a straw having a proximal end portion and a distal end portion, the proximal end portion of the straw having a terminal proximal edge;

inserting the straw into the elongated portion so that the proximal end portion of the straw is disposed adjacent the inner cavity;

closing the distal end portion of the straw with a cap portion;

perimetrically welding an outer wall of the straw to the package in a proximal sealing area at the proximal end portion of the straw to form a sealing ring extending from the terminal proximal edge of the straw and towards the distal end portion of the straw to prevent leakage of product from the inner cavity of the pocket portion along an outer surface of the outer wall of the straw;

filling the inner cavity of the pocket portion with a product through the access opening; and closing the access opening by welding.

12. The packaging method according to claim 11, wherein the distal end portion of the straw comprises a breakable portion, and the method further includes welding the breakable portion perimetrically to the cap portion of the package in a distal sealing area before the step of filling the inner cavity of the pocket portion.

13. The packaging method according to claim 11, including forming the package by welding two opposing shells to each other along a continuous sealing area, the welding of the package to the straw in the proximal sealing area being incorporated into the continuous sealing area of the package.

14. The unit of packaged product according to claim 1, wherein the sealing ring extends from the terminal proximal edge of the straw along approximately one third of a length of the straw.

15. The unit of packaged product according to claim 1, wherein the sealing ring starts at the terminal proximal edge of the straw and extends towards the distal end portion thereof.

16. The unit of packaged product according to claim 1, wherein the inner cavity of the pocket portion has an open end through which the product exits the inner cavity during use of the unit, the terminal proximal edge of the straw extending to and terminating at the open end.

17. The unit of packaged product according to claim 1, wherein the terminal proximal edge of the straw extends to, but not into, the open end of the inner cavity.

18. A unit of packaged product, said unit comprising a package, said package comprising a pocket portion defining a hollow inner cavity containing a product therein and having an open end through which the product exits said hollow inner cavity, an elongated portion connected to said pocket portion, a straw housed in said elongated portion and a cap portion, said elongated portion being disposed between said cap portion and said pocket portion, said straw having a proximal end portion disposed adjacent said hollow inner cavity in fluid communication with said open end thereof and a distal end portion spaced from said proximal end portion and closed by said cap portion, said proximal end portion of said straw having a terminal proximal edge extending to and terminating at said open end of said hollow inner cavity, said straw having an outer surface, said package comprising a sealing ring comprising a weld extending peripherally along said outer surface of said straw and interconnecting said proximal end portion thereof to said elongated portion of said package to prevent leakage of the product from said hollow inner cavity along said outer surface of said straw, said sealing ring at one end thereof originating at said terminal proximal edge of said straw and extending towards said distal end portion thereof.

19. The unit of packaged product according to claim 18, wherein said terminal proximal edge of said straw extends to and terminates at said open end of said hollow inner cavity so as not to extend into said hollow inner cavity.

20. The packaging method according to claim 11, wherein the step of inserting includes inserting the straw into the elongated portion so that the proximal end portion of the straw does not extend into the inner cavity.

* * * * *